United States Patent [19]

Pagano

[11] Patent Number: 4,950,974

[45] Date of Patent: Aug. 21, 1990

[54] CIRCUIT FOR PILOTING AN INDUCTIVE LOAD, PARTICULARLY FOR CONTROLLING THE ELECTRO-INJECTORS OF A DIESEL ENGINE

[75] Inventor: Roberto Pagano, Turin, Italy

[73] Assignee: Marelli Autronica S.p.A., Milano, Italy

[21] Appl. No.: 426,266

[22] Filed: Oct. 25, 1989

[30] Foreign Application Priority Data

Oct. 27, 1988 [IT] Italy ..... 67970 A/88

[51] Int. Cl.[5] ..... F02M 51/00

[52] U.S. Cl. ..... 323/222; 123/490; 307/41; 361/191

[58] Field of Search ..... 323/222, 285, 268; 361/166, 191, 187, 155; 123/480, 490; 307/41

[56] References Cited

U.S. PATENT DOCUMENTS 4,618,908 10/1986 Anttila ..... 361/187
4,862,866 9/1989 Calfus ..... 123/490

FOREIGN PATENT DOCUMENTS 277367 12/1986 Japan ..... 323/222
242982 5/1969 U.S.S.R. ..... 323/222

*Primary Examiner*—William H. Beha, Jr.
*Attorney, Agent, or Firm*—Sughrue, Mion, Zinn, Macpeak & Seas

[57] ABSTRACT

A circuit for piloting an inductive load comprises a low-voltage supply, a storage inductor interposed between one pole of the supply and the load, a first electronic switch in parallel with the load, a second electronic switch in series with the load, between the load and the other pole of the supply, a third electronic switch interposed between the first pole of the supply and the junction between the load and the second switch, and an electronic control unit arranged to pilot the switches in a predetermined manner.

The storage inductor is permanently connected to the first pole of the voltage supply and a conductive bypass path is provided between the first pole of the supply and the load. The control unit is arranged to cause the second and third electronic switches to open and close successively in counterphase, in order to maintain the current in the load at a predetermined average level.

3 Claims, 2 Drawing Sheets

Figure 1:
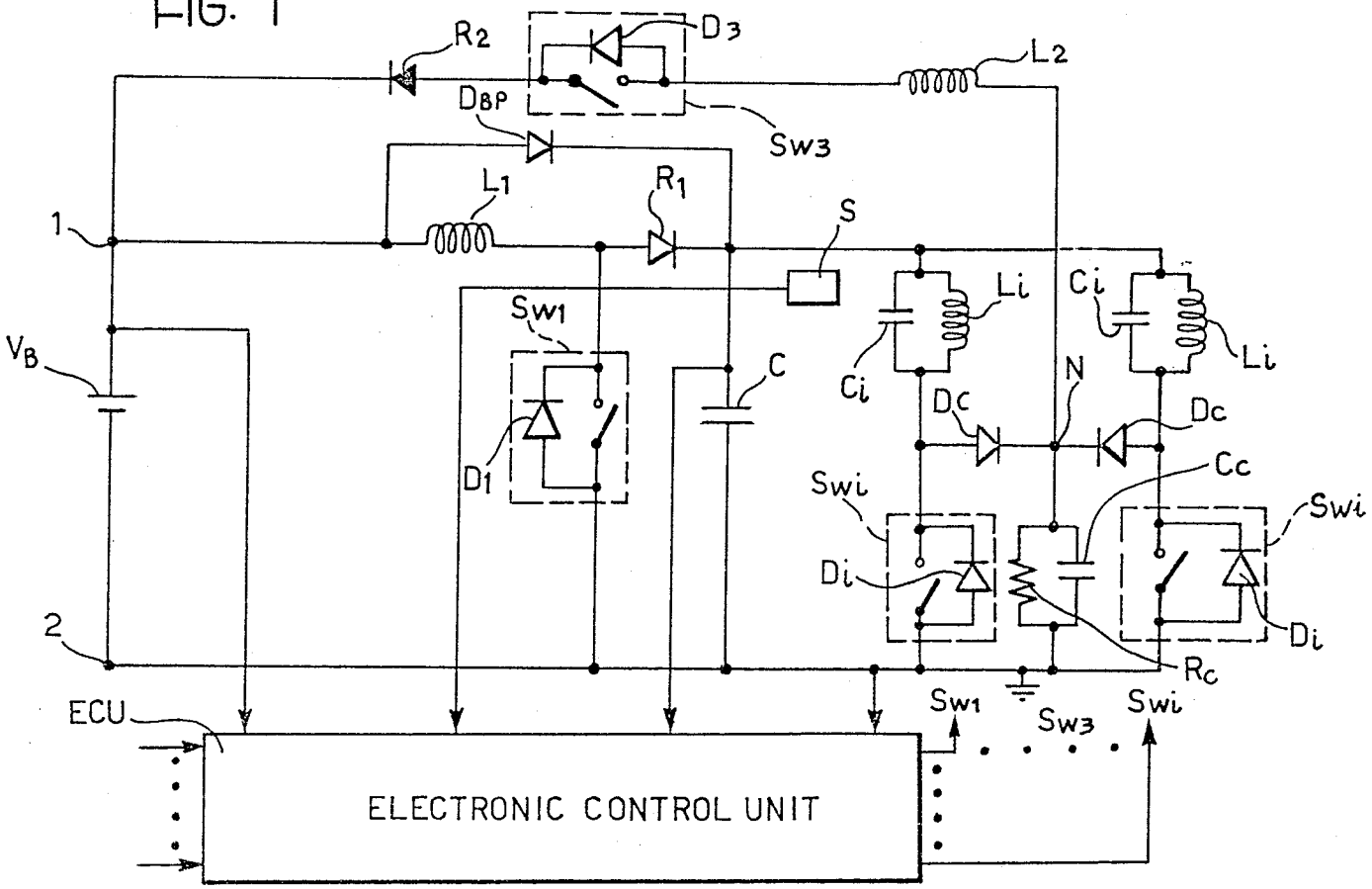

CIRCUIT FOR PILOTING AN INDUCTIVE LOAD, PARTICULARLY FOR CONTROLLING THE ELECTRO-INJECTORS OF A DIESEL ENGINE

The present invention relates to a circuit for piloting an inductive load, usable particularly for controlling the electro-injectors of a diesel engine.

More specifically, the subject of the invention is a circuit comprising:

a low-voltage supply, reactive circuit means including a storage inductor interposed between a first pole of the supply and the load, a first electronic switch in parallel with the branch circuit including the load, a second electronic switch in series with the load, between the load and the other pole of the supply, a third electronic switch interposed between the first pole of the supply and the junction between the load and the second switch, and an electronic control unit which, in order to energise the load, is arranged to pilot the switches in a predetermined manner so as to achieve:

—the storage of energy delivered by the supply in the storage inductor,

—the rapid transfer of current from the storage inductor to the load,

—the maintenance of the current in the load at a predetermined average level for a prefixed time, and —the de-energisation of the load and the return of the reactive energy stored in the load to the supply.

A circuit of the type specified above is described in detail in European Pat. application No. EP-A-O 305 344.

The circuit which forms the subject of the present patent application includes a further electronic switch interposed between the storage inductor and the first pole of the voltage supply. This further electronic switch (which, like the others, is typically constituted, for example, by a MOSFET transistor) is controlled by the electronic unit of the circuit: it is made conductive in order to initiate the flow of current from the supply to the storage inductor, whilst it can be de-activated in order to enable the rapid transfer of current from the storage inductor to the load. Moreover, in order to keep the current in the load at a predetermined average level, the electronic unit is arranged to cause the further electronic switch to open and close successively, and this can take place both when the current in the load is to be maintained at a prefixed maximum value for a certain period of time and when the current is to be maintained at a lower average "hold" value.

In the circuit according to previous European patent application No. EP-A-O 305344, the electronic switch which is interposed between the voltage supply and the junction between the load and the switch in series with the load has, in practice, the sole function of enabling the recovery of energy: each time the load is de-activated, the electronic control unit makes this switch conductive and a good part of the reactive energy stored in the load can therefore return through it to the supply.

The known circuit described above includes quite a large number of electronic switches and this involves heat-dissipation problems and the electronic unit having to pilot its operation in a relatively complex manner.

The object of the invention is to provide a circuit of the aforementioned type with a simplified circuit structure, whilst ensuring that it has the same performance as the previous circuit described above. More specifically, the object of the invention lies in the provision of a circuit of the aforesaid type which, in particular, has fewer electronic switches with the consequent advantages of a reduction in the dissipation of energy, a reduction of the average current consumed from the supply (for the same performance offered by the load), a reduction in costs, and simplified assembly, as well as a simplification of the manner in which the electronic control unit has to pilot the operation of the circuit.

According to the invention, this object is achieved by means of a circuit of the type defined above, whose main characteristic lies in the fact that the storage inductor is permanently connected to the first pole of the supply, a conductive bypass path being provided between the first pole of the supply and the load, and that the control unit is arranged to cause the second and third electronic switches to open and close successively in counterphase, in order to maintain the current in the load at a predetermined average level.

Figure 2:
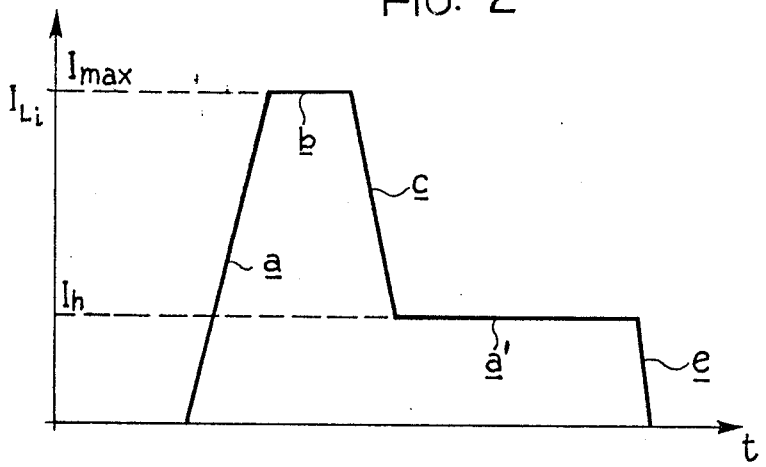
Figure 3:
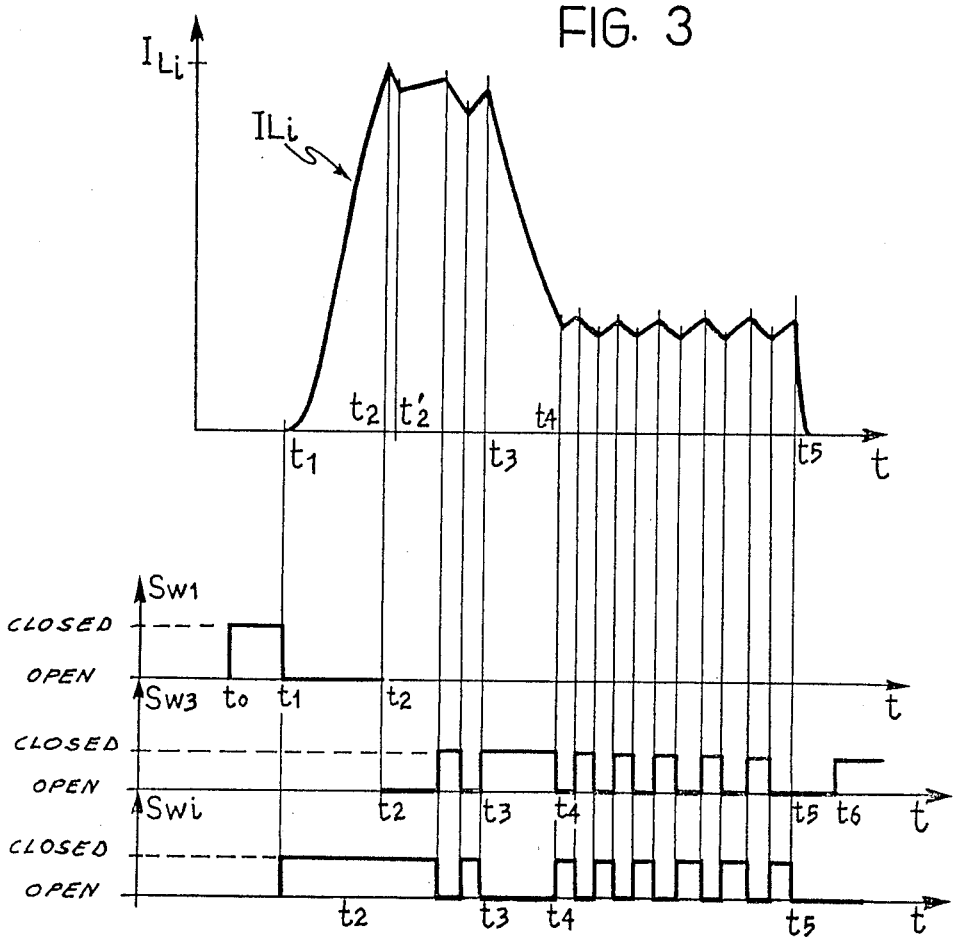

Further characteristics and advantages of the invention will become clear from the detailed description which follows with reference to the appended drawing, provided by way of non-limiting example, in which:

FIG. 1 is a detailed electrical diagram of a circuit according to the invention, FIG. 2 is a graph showing the ideal behaviour of the excitation current of the solenoid for controlling an electro-injector for diesel engines, as a function of time (shown on the abscissa), and FIG. 3 shows three graphs representing the actual behaviour of the current supplied to an inductive load by the circuit according to the invention, and a set of three graphs showing the corresponding states assumed by devices of the circuit according to the invention.

With reference to FIG. 1, a circuit according to the invention for piloting a plurality of inductive loads $L_i$ includes two input terminals 1 and 2 connected to the poles of a low-voltage, direct-current supply $V_B$, such as a battery. In particular, the inductive loads $L_i$ may represent the control solenoids of the electro-injectors of a diesel engine of a motor vehicle. In this case, the supply $V_B$ is constituted by the battery of the motor vehicle.

A storage inductor $L_1$ and a diode $R_1$, oriented in the manner illustrated, are arranged between the terminal 1 and the loads $L_i$.

A controlled electronic switch which is not inductive at rest is indicated $SW_1$. This switch has been shown as an on-off switch with a diode $D_1$ connected in parallel. This switch may be constituted, for example, by a MOSFET transistor and in this case the diode $D_1$ is constituted by its intrinsic parasitic diode.

A capacitor, indicated C, is arranged between the cathode of $R_1$ and the terminal 2 (which is connected to earth). A plurality of branch circuits, each including an inductive load $L_i$ connected in series with a controlled electronic switch $SW_i$ of a type similar to $SW_1$, is connected in parallel with this capacitor. A respective capacitor $C_i$ is connected in parallel with each load $L_i$ to enable the quenching, that is, the rapid zeroing, of the current in the corresponding load $L_i$ when it is de-activated.

A resistor and a capacitor, indicated $R_c$ and $C_c$, are connected in parallel with each other between the earth and a junction N to which are connected the cathodes of diodes $D_c$, each of which has its anode connected between a load $L_i$ and the associated controlled switch $SW_i$. The diodes $D_c$ together form an OR-type circuit.

A further controlled switch $SW_3$, similar to those mentioned above, is connected between the junction N and the input terminal 1.

An electronic control unit, indicated ECU, is formed in known manner and includes, for example, a microprocessor unit and input/output interfacing circuits.

The unit ECU has a series of inputs connected to the terminals 1 and 2 and to a sensor S for providing, in operation, electrical signals indicative of the current flowing towards the load $L_i$ which is energised at the time. The sensor S is interposed between the cathode of $R_1$ and the loads $R_i$, and may be constituted, for example, by a Hall-effect sensor. As an alternative to this solution, a shunt resistor connected between the cathode of R1 and the loads $L_i$, and of course connected to the ECU, may be used for detecting the current flowing towards the loads.

The unit has a plurality of outputs connected in order to the control inputs of the switches $SW_1$, $SW_i$ and $SW_3$.

In order to pilot the electro-injectors of a diesel engine, further electrical input signals, such as, for example, the rate of revolution of the engine, etc., may be supplied to the unit ECU.

A bypass diode, indicated $D_{BP}$, has its anode connected to the terminal 1 and its cathode connected to that of $R_1$.

An inductor, indicated $L_2$, is interposed between the junction N and $SW_3$. A further diode $R_2$ is arranged between $SW_3$ and the terminal 1, with its cathode connected to that terminal.

Before the operation of the circuit of FIG. 1 is described, some comments will be made concerning the ideal behaviour of the current $I_{Li}$ for controlling the electro-injectors of an internal combustion diesel engine. This ideal behaviour is shown in FIG. 2 as a function of the time t. The ideal curve shown has a slope a indicating a rapid increase in current, followed by a stage b indicating a substantially constant, high current intensity $I_{max}$. There then follows a transition c towards a lower, holding current level $I_h$. This current is maintained for a certain time period (section d of the graph) and the current is then "quenched" (stage e) with possible inversion and final zeroing of the current.

FIG. 3 shows the states of $SW_1$, $SW_2$ and the switch $SW_i$ associated with the load $L_i$ to be energised, and the corresponding actual behaviour of the current $I_{Li}$ in the load.

In order to make a current pass through the load $L_i$, the control unit ECU closes the switch $SW_1$ at a time $t_o$. The other switches, however, remain open. In this condition, a current delivered by the battery $V_B$ flows into the storage inductor $L_1$ and energy is stored.

At a subsequent time $t_l$, the switch $SW_1$ is opened, whilst the switch $SW_i$ associated with the load to be energised is closed. In this condition, the storage inductor $L_1$ is connected to the capacitor C with which it forms a resonant circuit. This resonant circuit is discharged to the load $L_i$ associated with the switch $SW_i$ which is closed. The current in the storage inductor $L_i$ decreases whilst the current in the selected load $L_i$ increases from the time $t_1$ to a maximum value which is reached at a time $t_2$, and then starts to decline. In this situation, a current flows from the supply to the load $L_i$ through the bypass diode $D_{EP}$ so that, starting from the time $t_2$, the current in the load $L_i$ starts to rise again. As soon as this current reaches a predetermined value, the unit ECU causes $SW_3$ and $SW_i$ to open and close successively in counterphase, with consequent "chopping" of the current $I_{Li}$, as shown in FIG. 3.

The unit ECU changes the current $I_{Li}$ to the desired holding level by opening the switch $SW_i$ associated with the energised load and simultaneously closing $SW_3$ (at the time indicated $t_3$ in FIG. 3): in this condition, the current flows in the loop formed by the energised load $L_i$, the associated diode $D_C$, the inductor $L_2$, the switch $SW_3$ and the diodes $R_2$ and $D_{BP}$. The unit ECU monitors the progressive decrease in the intensity of the current $I_{Li}$ by means of the sensor S.

As soon as the current $I_{Li}$ reaches the preset holding value $I_h$, the unit ECU causes the switch $SW_i$ associated with the energised load and the switch $SW_3$ to be opened and closed successively in counterphase, as shown in FIG. 3 between the times $t_4$ and $t_5$.

Finally, in order rapidly to cut off the current in the energised load $L_i$, the unit ECU (at the time $t_5$) simultaneously opens the switch $SW_i$ associated with the energised load and the switch $SW_3$: current flowing in the load is discharged and charges the capacitor $C_c$ and, after a certain time, at the time $t_6$, the capacitor is discharged to the battery $V_B$ and the unit ECU then causes the closure of $SW_3$. The inductor $L_2$ serves to protect the switch $SW_3$ by limiting the rate of variation of the current in the switch during energy recovery stages and particularly at the end of the de-activation cycle of each load.

What is claimed is:

1. A circuit for piloting an inductive load, and particularly but not exclusively for controlling an electro-injector of a diesel engine, comprising:

a low-voltage supply, reactive circuit means including a storage inductor interposed between a first pole of the supply and the load, a branch circuit including the load, a first electronic switch in parallel with the branch circuit including the load, a second electronic switch in series with the load, between the load and the other pole of the supply, a third electronic switch interposed between the first pole of the supply and the junction between the load and the second switch, and an electronic control unit which, in order to energise the load, is arranged to pilot the electronic switches in a predetermined manner so as to achieve the storage of energy delivered by the supply in the storage inductor, the rapid transfer of current from the storage inductor to the load, the maintenance of the current in the load at a predetermined average level for a prefixed time, and the de-energisation of the load and the return of the reactive energy stored in the load to the supply, wherein the storage inductor is permanently connected to the first pole of the supply, a conductive bypass being provided between the first pole of the supply and the load, and the control unit is arranged to cause the second and third electronic switches to open and close successively in counterphase so as to maintain the current in the load at the predetermined average level.

2. A circuit according to claim 1, wherein a device for limiting the rate of variation of the current is arranged in series with the third electronic switch.

3. A circuit according to claim 2, wherein the device for limiting the rate of variation of the current is constituted by an inductor.

* * * * *